US008523330B2

(12) United States Patent
Ueno

(10) Patent No.: US 8,523,330 B2
(45) Date of Patent: Sep. 3, 2013

(54) RECORDING APPARATUS, LIQUID DROPLET DISCHARGING HEAD, AND LIQUID DROPLET DISCHARGING HEAD CIRCUIT BOARD WITH IMPROVED WIRING PATTERN

(75) Inventor: Kaichi Ueno, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 1232 days.

(21) Appl. No.: 11/701,611

(22) Filed: Feb. 2, 2007

(65) Prior Publication Data

US 2007/0176975 A1 Aug. 2, 2007

(30) Foreign Application Priority Data

Feb. 2, 2006 (JP) ..... 2006-026413
Oct. 13, 2006 (JP) ..... 2006-280752

(51) Int. Cl.
*B41J 2/05* (2006.01)

(52) U.S. Cl.
USPC ..... 347/59; 347/58; 347/62

(58) Field of Classification Search
USPC ..... 347/58, 59, 62
See application file for complete search history.

(56) References Cited

U.S. PATENT DOCUMENTS 6,149,265 A * 11/2000 Watanabe ..... 347/58
6,409,315 B2 * 6/2002 Komuro ..... 347/58

FOREIGN PATENT DOCUMENTS

| | | |
|---|---|---|
| JP | 60-105148 | 7/1985 |
| JP | 2-269058 | 11/1990 |
| JP | 9-174841 | 7/1997 |
| JP | 2836167 | 10/1998 |
| JP | 2000-15800 | 1/2000 |
| JP | 2001-219563 | 8/2001 |
| JP | 2001-341311 | 12/2001 |
| JP | 2003-72088 | 3/2003 |
| JP | 2004-1490 | 1/2004 |
| JP | 2004-55845 | 2/2004 |
| JP | 3526822 | 2/2004 |
| JP | 2004-106089 | 4/2004 |

OTHER PUBLICATIONS

Showko Shiokawa et al., "Study on SAW Streaming and its Application to Fluid Devices", Technical Report of the Institute of Electronics, Information and Communication Engineers (1989), vol. 89, No. 247, pp. 41-46.
Jul. 26, 2011 Japanese official action in connection with a counterpart Japanese patent application.

* cited by examiner

*Primary Examiner* — Uyen Chau N Le
*Assistant Examiner* — John M Bedtelyon
(74) *Attorney, Agent, or Firm* — Cooper & Dunham LLP

(57) ABSTRACT

A recording apparatus includes a liquid droplet discharging head and a tank. The liquid droplet discharging head discharges a liquid droplet. The tank supplies a liquid to the liquid droplet discharging head. The liquid droplet discharging head includes a liquid droplet discharging head circuit board including a board substrate and a writing pattern. The wiring pattern is located on the board substrate to supply power and includes a plurality of divided wiring patterns formed by dividing at least a part of the wiring pattern in a width direction of the wiring pattern.

12 Claims, 10 Drawing Sheets

RECORDING APPARATUS, LIQUID DROPLET DISCHARGING HEAD, AND LIQUID DROPLET DISCHARGING HEAD CIRCUIT BOARD WITH IMPROVED WIRING PATTERN

TECHNICAL FIELD

The present specification describes a recording apparatus, a liquid droplet discharging head, and a liquid droplet discharging head circuit board, and more particularly a recording apparatus, a liquid droplet discharging head, and a liquid droplet discharging head circuit board for discharging a liquid droplet by converting electric power into liquid droplet discharging energy.

DISCUSSION OF THE BACKGROUND

A recording apparatus, such as a copying machine, a printer, a facsimile machine, or a multifunction printer having copying, printing, scanning, and facsimile functions, forms an image on a recording medium (for example, a sheet) with ink and according to image data. For example, an ink droplet is discharged from a nozzle of a recording head. While the recording head moves in a main scanning direction, the recording head discharges an ink droplet onto a sheet to form an image on the sheet.

Generally, the recording head discharges an ink droplet by a bubble jet method, a piezo jet method, or a liquid droplet jet method. In the bubble jet method, a heater heats the ink to generate a bubble. A pressure of the bubble discharges an ink droplet from the recording head. In the piezo jet method, an ink droplet is discharged by an electric and mechanical displacement of a bulk of a piezoelectric element. In the liquid droplet jet method, a micro fluid element and a surface acoustic wave propagate in the ink to cause ejection of an ink droplet. In the bubble jet method, the piezo jet method, and the liquid droplet jet method, electric power of from 0.1 watts to several watts is needed, resulting in migration and a broken wire.

To address the above-described problems, the recording head includes a liquid droplet discharging head circuit board in which a protective layer is formed on a wiring pattern. FIGS. 1 and 2 illustrate a liquid droplet discharging head circuit board 100R of the recording head. FIG. 1 is a plane view of the liquid droplet discharging head circuit board 100R. FIG. 2 is a sectional view of the liquid droplet discharging head circuit board 100R taken along line A1-A1 of FIG. 1. As illustrated in FIGS. 1 and 2, the liquid droplet discharging head circuit board 100R includes a board 1R, an oxide film 2R, an electricity-heat conversion element 3R, and a wiring pattern 4R. As illustrated in FIG. 2, the liquid droplet discharging head circuit board 100R further includes a first protective layer 5R and a second protective layer 6R.

The board 1R includes silicon. The oxide film 2R is formed on the board 1R. The electricity-heat conversion element 3R includes a heat-generating resistance body film formed at a predetermined position on the oxide film 2R and having a predetermined size. The electricity-heat conversion element 3R serves as a discharging energy generating element. The wiring pattern 4R is formed on the oxide film 2R and has a predetermined pattern. The wiring pattern 4R electrically connects the electricity-heat conversion element 3R to a power source (not shown) to supply power to the electricity-heat conversion element 3R. The first protective layer 5R is formed on the electricity-heat conversion element 3R and the wiring pattern 4R to cover the electricity-heat conversion element 3R and the wiring pattern 4R, and includes an insulating material. The second protective layer 6R is formed on the first protective layer 5R and includes an insulating material. The wiring pattern 4R includes a broad band conductive film having a substantially constant thickness. A width W1 of the wiring pattern 4R is not smaller than about 10 μm, for example.

The first protective layer 5R can reduce migration. However, the first protective layer 5R cannot directly prevent a broken wire of the wiring pattern 4R.

SUMMARY

This patent specification describes a novel recording apparatus. One example of a novel recording apparatus includes a liquid droplet discharging head and a tank. The liquid droplet discharging head discharges a liquid droplet. The tank supplies a liquid to the liquid droplet discharging head. The liquid droplet discharging head includes a liquid droplet discharging head circuit board including a board substrate and a writing pattern. The wiring pattern is located on the board substrate to supply power and includes a plurality of divided wiring patterns formed by dividing at least a part of the wiring pattern in a width direction of the wiring pattern.

This patent specification further describes a novel liquid droplet discharging head for discharging a liquid droplet. One example of a novel liquid droplet discharging head includes a liquid droplet discharging head circuit board and a liquid droplet outlet. A liquid droplet is discharged through the liquid droplet outlet. The liquid droplet discharging head circuit board includes a board substrate and a wiring pattern. The wiring pattern is located on the board substrate to supply power and includes a plurality of divided wiring patterns formed by dividing at least a part of the wiring pattern in a width direction of the wiring pattern.

This patent specification further describes a novel liquid droplet discharging head circuit board. One example of a novel liquid droplet discharging head circuit board includes a board substrate and a wiring pattern. The wiring pattern is located on the board substrate to supply power and includes a plurality of divided wiring patterns formed by dividing at least a part of the wiring pattern in a width direction of the wiring pattern.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
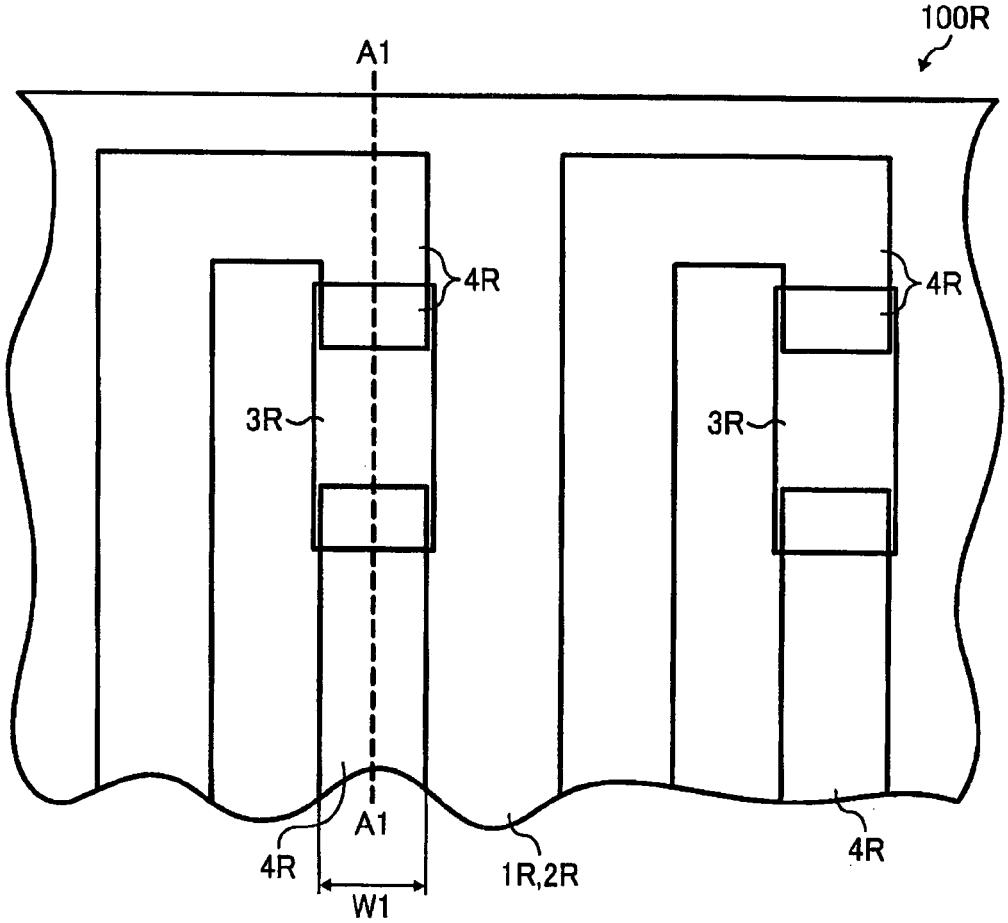
FIG. 1 RELATED ART
FIG. 1 is a plane view of a related art liquid droplet discharging head circuit board.
Figure 2:
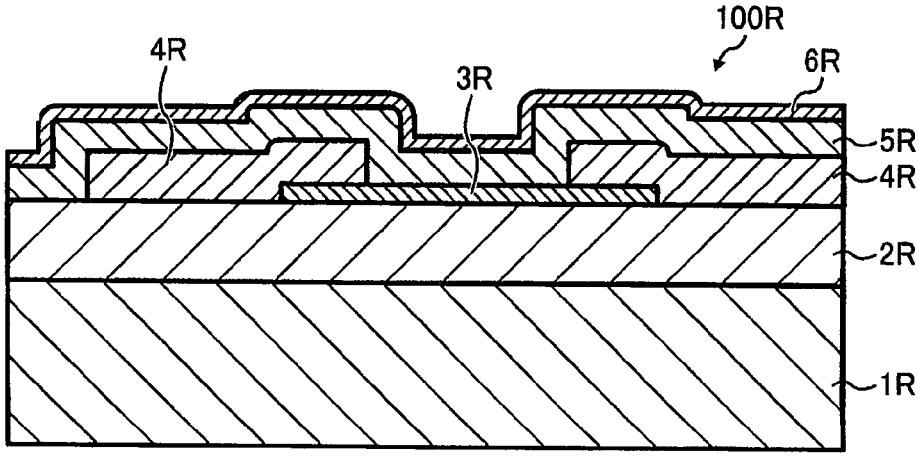
FIG. 2 RELATED ART
FIG. 2 is a sectional view of the liquid droplet discharging head circuit board shown in FIG. 1, taken along line A1-A1 of FIG. 1.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 3:
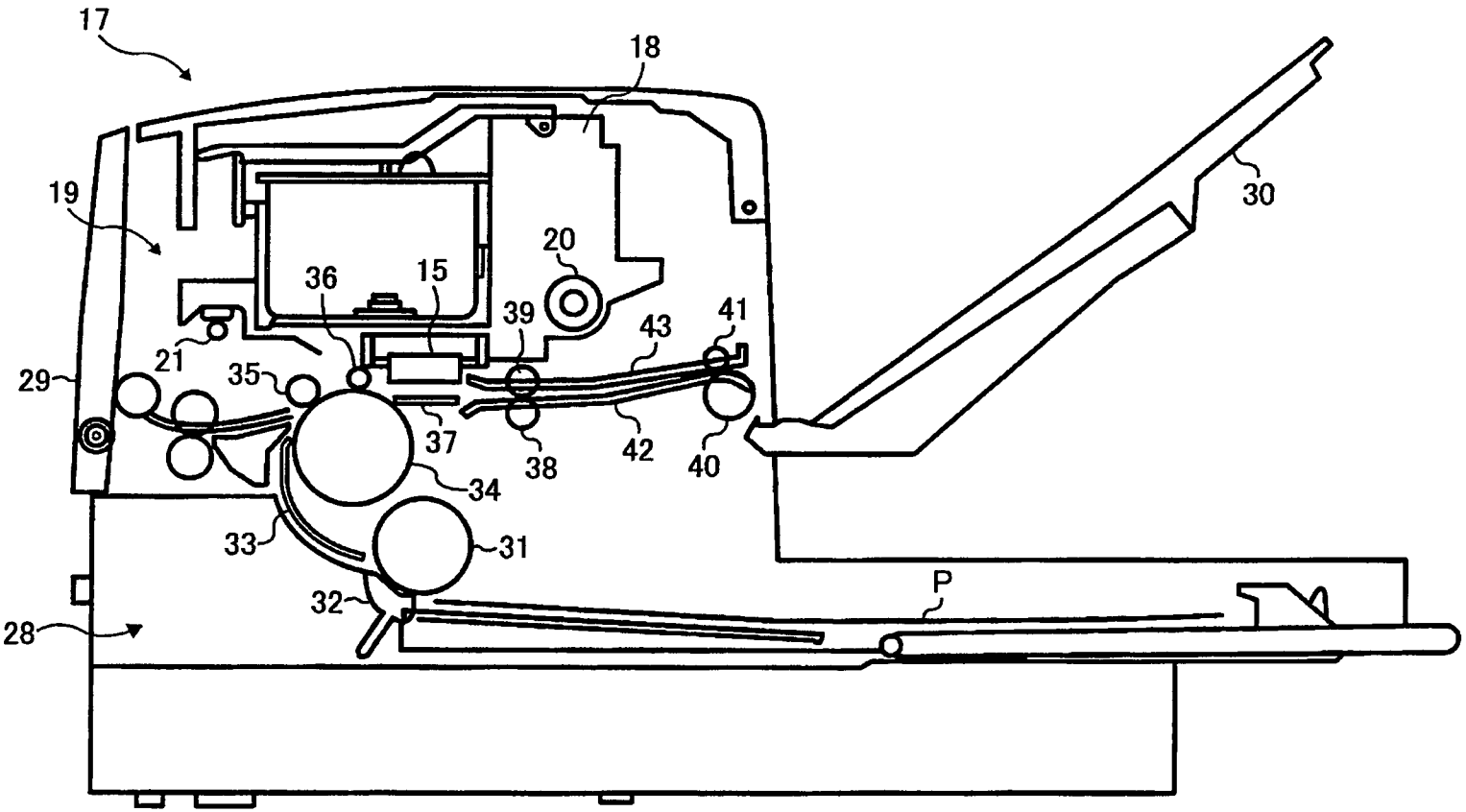
FIG. 3 is a schematic view of a recording apparatus according to an exemplary embodiment.

Referring now to the drawings, wherein like reference numerals designate identical or corresponding parts throughout the several views, in particular to FIG. 3, an image forming apparatus 17 according to an exemplary embodiment is explained.

FIG. 3 is a sectional view of the image forming apparatus 17. As illustrated in FIG. 3, the image forming apparatus 17 includes a paper tray 28, a bypass tray 29, a feeding roller 31, a friction pad 32, a guide 33, a conveying roller 34, a roller 35, a regulating roller 36, a guide 37, a printing mechanism 19, a conveying roller 38, a spur 39, an output roller 40, a spur 41, guides 42 and 43, and an output tray 30. The printing mechanism 19 includes a carriage 18, a plurality of recording heads 15, a main guide rod 20, and a sub guide rod 21.

The image forming apparatus 17, serving as a recording apparatus, may be a copying machine, a printer, a facsimile machine, and a multifunction printer having copying, printing, scanning, and facsimile functions. In this non-limiting exemplary embodiment, the image forming apparatus 17 functions as a color printer for forming a color image on a recording medium. However, the image forming apparatus 17 may be a monochrome printer for forming a monochrome image on a recording medium and may include a single recording head 15.

The paper tray 28 is disposed in a lower portion of the image forming apparatus 17 and is attachable to and detachable from the front of the image forming apparatus 17. The paper tray 28 loads a recording medium (for example, sheets P). The bypass tray 29 is opened from and closed to a side of the image forming apparatus 17. The bypass tray 29 loads a special sheet P (for example, thick paper, a postcard, and an OHP (overhead projector) transparency). The feeding roller 31 and the friction pad 32 feed sheets P one by one from the paper tray 28. The guide 33 guides the sheet P toward the conveying roller 34. The conveying roller 34 conveys and reverses the sheet P. The roller 35 pressingly contacts an outer circumferential surface of the conveying roller 34 and feeds the sheet P toward the regulating roller 36. When a sheet P is placed on the bypass tray 29, rollers (not shown) disposed between the bypass tray 29 and the roller 35 feed the sheet P from the bypass tray 29 toward the roller 35. The regulating roller 36 regulates an angle of the sheet P fed by the conveying roller 34 and the roller 35, and feeds the sheet P toward the printing mechanism 19. A sub-scanning motor (not shown) rotates the conveying roller 34 via gears. The guide 37 is disposed under the printing mechanism 19, and guides the sheet P fed by the feeding roller 34 and the regulating roller 36 toward the conveying roller 38 and the spur 39. The printing mechanism 19 forms an image on the sheet P according to image data. The conveying roller 38 and the spur 39 are disposed downstream from the guide 37, and feed the sheet P bearing the image toward the output roller 40 and the spur 41. The guides 42 and 43 form an output path between the guide 37 and the output tray 30, and guide the sheet P bearing the image from the guide 37 toward the output tray 30. The output roller 40 and the spur 41 feed the sheet P bearing the image onto the output tray 30. The output tray 30 receives the sheet P bearing the image.

The carriage 18 is movable in a main scanning direction and carries the recording heads 15. The main guide rod 20 and the sub guide rod 21 are supported by side plates (not shown) and slidably support the carriage 18 in a manner that the carriage 18 is movable in the main scanning direction. The recording heads 15, serving as liquid droplet discharging heads, discharge liquid droplets (for example, ink droplets) onto a sheet P fed by the conveying roller 34 and the regulating roller 36.

To start printing an image on a sheet P, the carriage 18 moves in the main scanning direction so that the recording heads 15 mounted on the carriage 18 discharge ink droplets according to an image signal. Specifically, the recording heads 15 discharge ink droplets onto a sheet P while the sheet P stops so as to print an image for one line. The sheet P is conveyed for a predetermined length so as to print an image for the next line. When a signal to finish the printing operation or a signal indicating that the tail edge of the sheet P in a sheet conveyance direction reaches a printing area of the printing mechanism 19 is output, the printing operation is finished and the sheet P is output onto the output tray 30.

Figure 4:
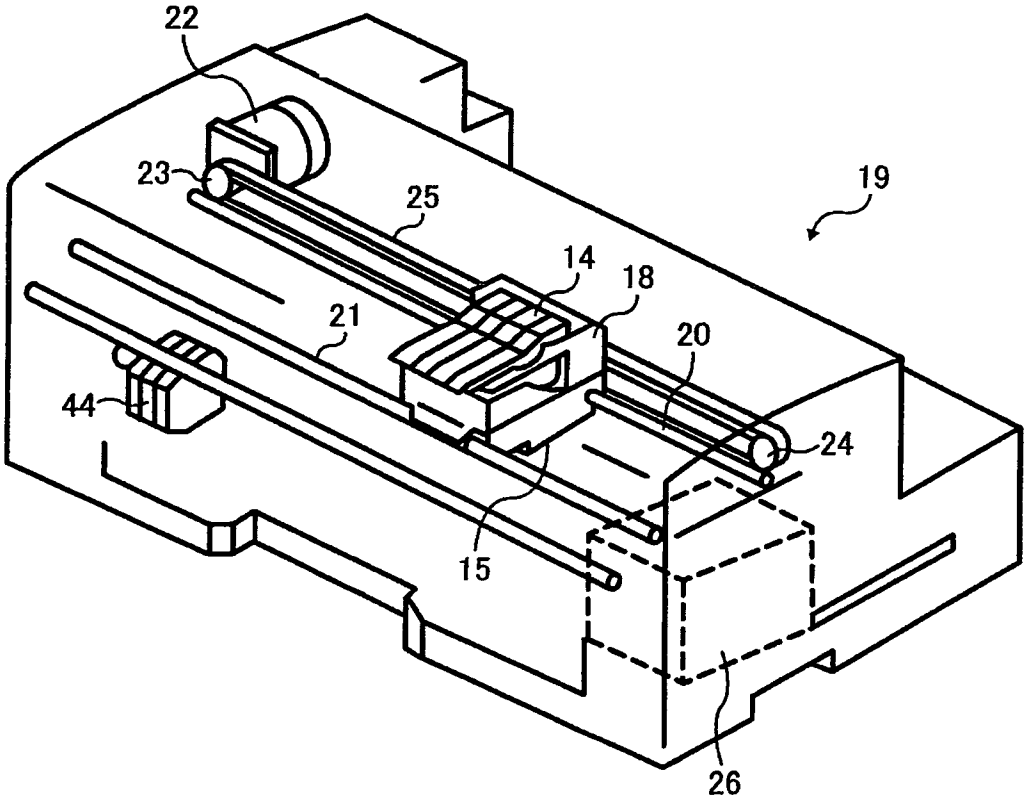
FIG. 4 is a perspective view of a printing mechanism of the recording apparatus shown in FIG. 3.

FIG. 4 is a perspective view of the printing mechanism 19. As illustrated in FIG. 4, the printing mechanism 19 further includes ink cartridges 14, a sub scanning motor 44, a main scanning motor 22, a driving pulley 23, a timing belt 25, a driven pulley 24, and a recovery device 26.

The recording heads 15 discharge ink droplets in yellow, cyan, magenta, and black colors. Each of the recording heads 15 includes a nozzle (not shown) for discharging an ink droplet. The nozzles of the recording heads 15 are arranged in a direction perpendicular to the main scanning direction in a manner that the nozzles discharge ink droplets downward onto a sheet P. The ink cartridges 14, serving as liquid cartridges, contain yellow, cyan, magenta, and black inks, respectively. The carriage 18 carries the ink cartridges 14. The ink cartridges 14 can be replaced with new ones when the ink cartridges 14 become empty.

The ink cartridge 14 includes a ventilation hole (not shown), an ink supplying hole (not shown), and a porous body (not shown). The ventilation hole is disposed in an upper portion of the ink cartridge 14. The ink supplying hole is disposed in a lower portion of the ink cartridge 14 and supplies ink to the recording head 15. The porous body is disposed in the ink cartridge 14 and contains ink. A capillary force of the porous body maintains the ink to be supplied to the recording head 15 to have a slight, negative pressure. According to this non-limiting exemplary embodiment, the printing mechanism 19 includes a plurality of recording heads (i.e., the recording heads 15). However, the printing mechanism 19 may include a single recording head.

The carriage 18 slidably engages with the main guide rod 20 at a rear portion of the carriage 18 (i.e., at a downstream portion in the sheet conveyance direction). The carriage 18 slidably engages with the sub guide rod 21 at a front portion of the carriage 18 (i.e., at an upstream portion in the sheet conveyance direction). The sub scanning motor 44 moves the carriage 18 in a sub scanning direction.

The main scanning motor 22 moves the carriage 18 in the main scanning direction. Specifically, the main scanning motor 22 drives the driving pulley 23. The timing belt 25 is looped over the driving pulley 23 and the driven pulley 24. The rotating driving pulley 23 rotates the driven pulley 24 via the timing belt 25. The timing belt 25 is fixed to the carriage 18. Thus, when the main scanning motor 22 rotates back and forth, the carriage 18 moves back and forth in the main scanning direction.

The recovery device 26 is disposed in one of non-printing areas in the main scanning direction, where the recording heads 15 do not discharge ink droplets onto a sheet P. The recovery device 26 recovers the recording heads 15. The recovery device 26 includes caps (not shown), sucking members (not shown), cleaners (not shown), and a waste ink container (not shown).

While the recording heads 15 are in a standby mode and do not discharge ink droplets, the carriage 18 stops above the recovery device 26. The caps of the recovery device 26 cap the nozzles of the recording heads 15 to cause the nozzles to retain moisture. Thus, ink droplets on the nozzles are not dried and thereby faulty discharging can be prevented. Further, the recording heads 15 discharge ink droplets not used for printing an image on a sheet P. Thus, viscosities of ink droplets on the nozzles are maintained at a predetermined level and thereby a steady discharging performance level may be maintained.

In the recovery device 26, when faulty discharging occurs, the caps cap the nozzles. The sucking members are connected to the caps, and suck ink droplets and air bubbles from the nozzles of the recording heads 15 via tubes (not shown). The cleaners remove ink droplets and dust adhered to the nozzles. Thus, faulty discharging is dissolved. The sucked ink droplets are delivered to the waste ink container disposed in a lower portion of the image forming apparatus 17 (depicted in FIG. 3). The waste ink container contains an ink absorber for absorbing and holding the ink droplets.

Figure 5:
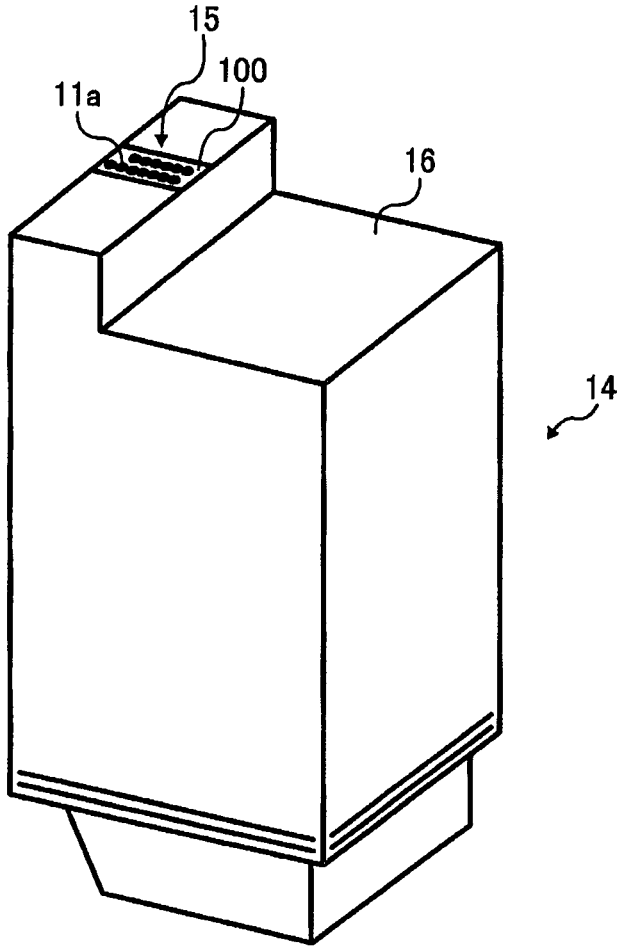
FIG. 5 is a perspective view of a liquid cartridge of the printing mechanism shown in FIG. 4.

FIG. 5 is a perspective view of the ink cartridge 14. As illustrated in FIG. 5, the ink cartridge 14 includes the recording head 15 and an ink tank 16. The recording head 15 includes a liquid droplet discharging head circuit board 100 and an ink outlet 11*a*. The ink tank 16 for holding a supply of ink, serving as a tank for holding a supply of ink, supplies ink to the recording head 15. In the ink cartridge 14, the ink tank 16 is integrated with the recording head 15 including the liquid droplet discharging head circuit board 100. The liquid droplet discharging head circuit board 100 converts electric power into ink droplet discharging energy to discharge an ink droplet. The ink droplet is discharged through the ink outlet 11*a* (i.e., a liquid droplet outlet) onto a sheet P.

When the ink tank is integrated with the recording head in conventional ink cartridges, a decreased yield of the recording head causes a failure of the ink cartridge. On the other hand, when the recording head 15 is configured as described above to reduce ink droplet discharging errors of the recording head 15 caused by heat, the number of defective ink cartridges 14 produced in manufacturing processes can be reduced, resulting in an increased yield and reduced manufacturing costs of the ink cartridge 14.

Figure 6:
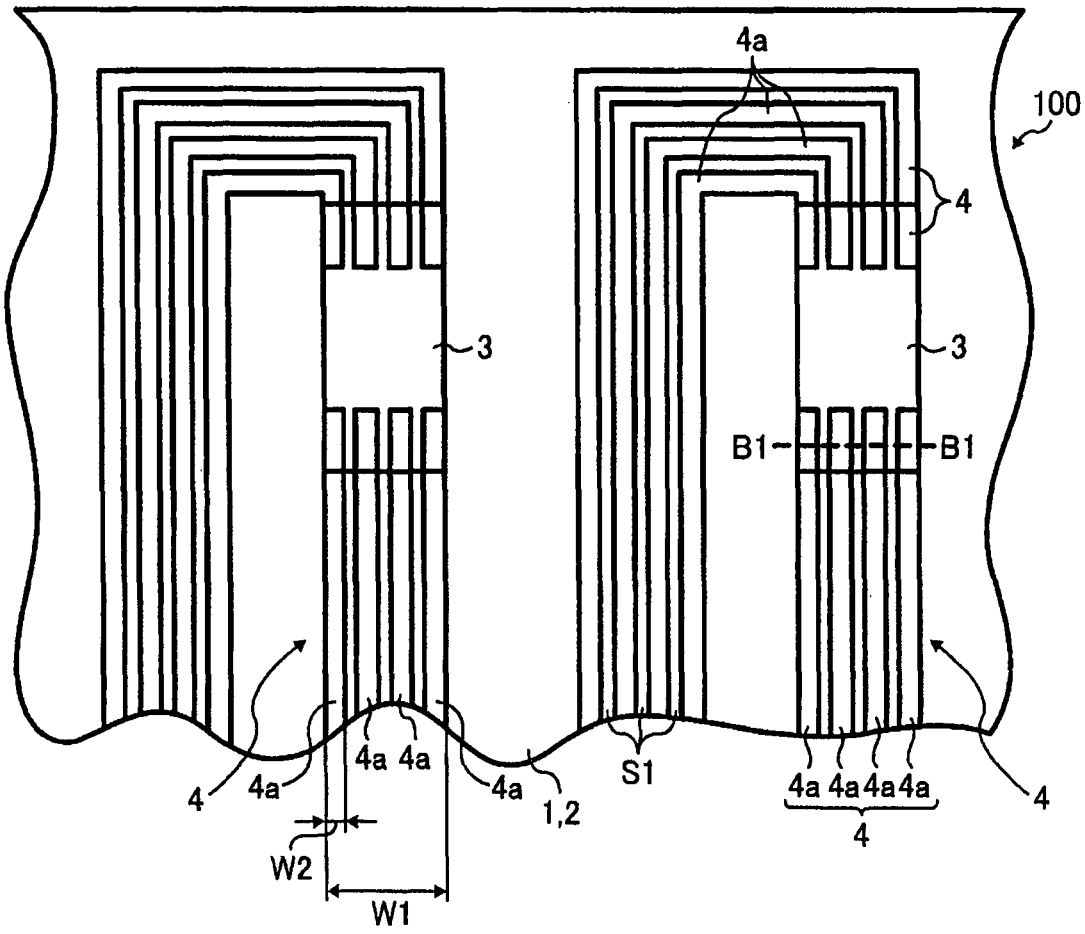
FIG. 6 is a plane view of a liquid droplet discharging head circuit board of the liquid cartridge shown in FIG. 5.
Figure 7:
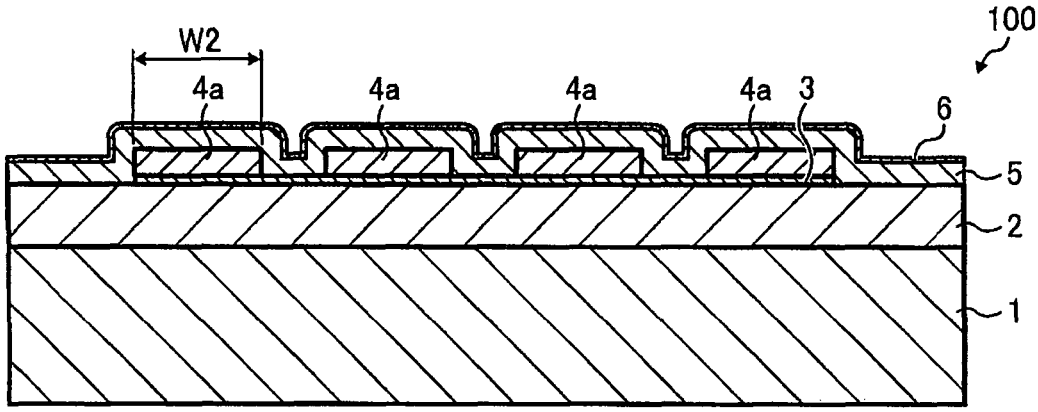
FIG. 7 is a sectional view of the liquid droplet discharging head circuit board shown in FIG. 6, taken along line B1-B1 of FIG. 6.

FIGS. 6 and 7 illustrate the liquid droplet discharging head circuit board 100 according to an exemplary embodiment. FIG. 6 is a plane view of the liquid droplet discharging head circuit board 100. FIG. 7 is a sectional view of the liquid droplet discharging head circuit board 100 taken along line B1-B1 of FIG. 6. As illustrated in FIGS. 6 and 7, the liquid droplet discharging head circuit board 100 includes a board substrate 1 (depicted in FIGS. 6 and 7), an oxide film 2 (depicted in FIGS. 6 and 7), an electricity-heat conversion element 3 (depicted in FIGS. 6 and 7), a wiring pattern 4 (depicted in FIG. 6), a first protective layer 5 (depicted in FIG. 7), and a second protective layer 6 (depicted in FIG. 7). The wiring pattern 4 includes a plurality of divided wiring patterns 4*a* (depicted in FIGS. 6 and 7) and a plurality of slits S1 (depicted in FIG. 6).

The board substrate 1 includes silicon. The oxide film 2 is formed on the board substrate 1. The electricity-heat conversion element 3, serving as a discharging energy generating element, includes a heat-generating resistance body film formed at a predetermined position on the oxide film 2 and having a predetermined size. The electricity-heat conversion element 3 bridges both end portions of the wiring pattern 4 formed on the oxide film 2. The wiring pattern 4 is formed on the oxide film 2 and has a predetermined pattern. The wiring pattern 4 includes a conductive material and electrically connects the electricity-heat conversion element 3 to a power source (not shown) to supply power to the electricity-heat conversion element 3. The first protective layer 5 is formed on the electricity-heat conversion element 3 and the wiring pattern 4 and includes an insulating material. The second protective layer 6 is formed on the first protective layer 5 and includes an insulating material.

A width W1 (depicted in FIG. 6) of the wiring pattern 4 is not smaller than about 10 μm for example. At least a part of the wiring pattern 4 is divided in a width direction of the wiring pattern 4 into the plurality of divided wiring patterns 4*a*. According to this non-limiting exemplary embodiment, the wiring pattern 4 is divided into four divided wiring patterns 4*a*, for example. The divided wiring pattern 4*a* has a narrow width (i.e., a width W2 depicted in FIGS. 6 and 7). Namely, the wiring pattern 4 does not include a conductive film having the width W1 like the wiring pattern 4R having the width W1 illustrated in FIG. 1, but includes the plurality of divided wiring patterns 4*a* arranged in parallel to each other. The slit S1, at which the oxide film 2 is exposed, is formed between the adjacent divided wiring patterns 4*a*. Thus, the plurality of slits S1 extend in a longitudinal direction of the divided wiring patterns 4*a*.

The width W2 corresponds to a width of an area in which an allowable electric current per unit wiring width increases.

As described above, according to this non-limiting exemplary embodiment, the liquid droplet discharging head circuit board 100 includes the electricity-heat conversion element 3 and the wiring pattern 4. The electricity-heat conversion element 3 bubbles the ink so that the nozzle of the recording head 15 discharges an ink droplet. The wiring pattern 4 connects the electricity-heat conversion element 3 to the power source to supply power to the electricity-heat conversion element 3. At least a part of the wiring pattern 4 is divided into the plurality of divided wiring patterns 4*a* having a narrow width in the width direction of the wiring pattern 4. The divided wiring patterns 4*a* are spaced from each other with the slit S1 in between. According to this non-limiting exemplary embodiment, the wiring pattern 4 is divided into the four divided wiring patterns 4*a*. However, the wiring pattern 4 may be divided into an arbitrary number of the divided wiring patterns 4*a*.

Figure 8:
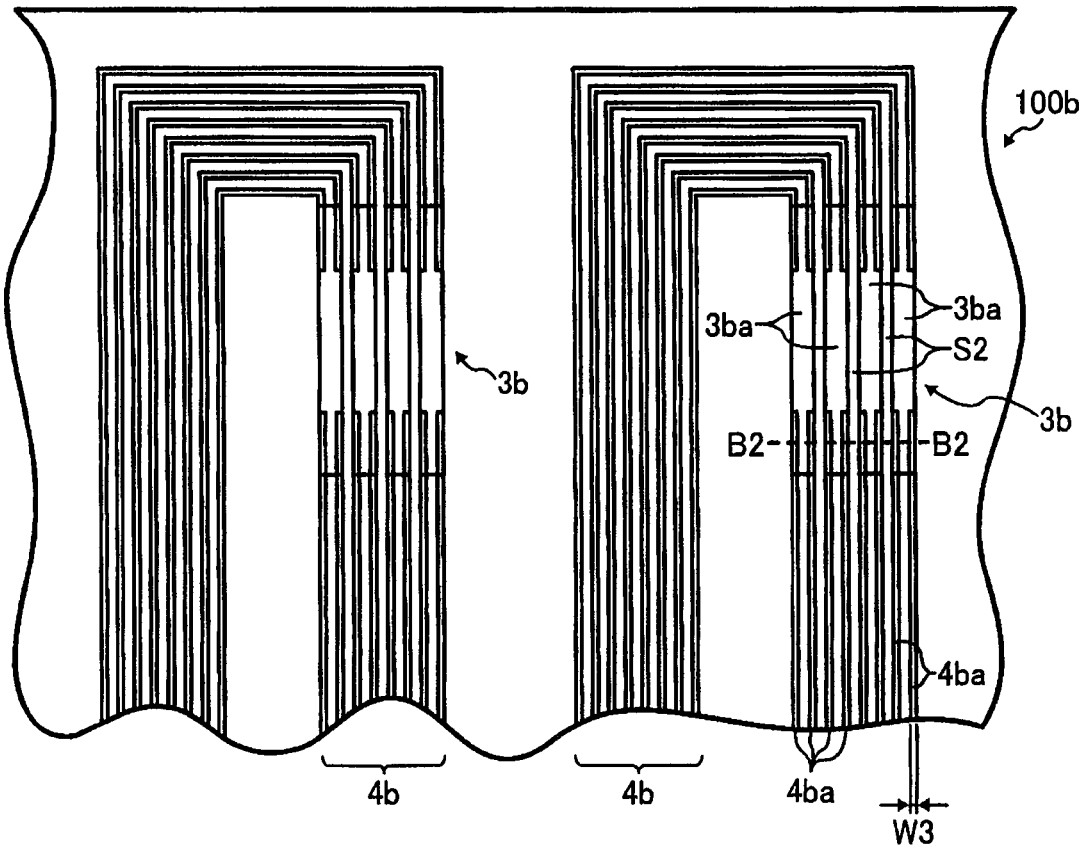
FIG. 8 is a plane view of a liquid droplet discharging head circuit board of the liquid cartridge shown in FIG. 5, according to another exemplary embodiment.
Figure 9:
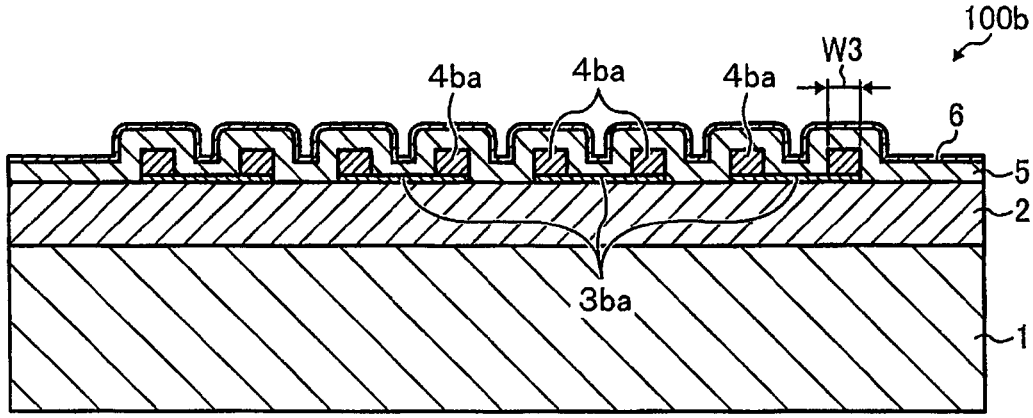
FIG. 9 is a sectional view of the liquid droplet discharging head circuit board shown in FIG. 8, taken along line B2-B2 of FIG. 8.

FIGS. 8 and 9 illustrate a liquid droplet discharging head circuit board 100*b* according to another exemplary embodiment. FIG. 8 is a plane view of the liquid droplet discharging head circuit board 100*b*. FIG. 9 is a sectional view of the liquid droplet discharging head circuit board 100*b* taken along line B2-B2 of FIG. 8. As illustrated in FIGS. 8 and 9, the liquid droplet discharging head circuit board 100*b* includes the board substrate 1 (depicted in FIG. 9), the oxide film 2 (depicted in FIG. 9), an electricity-heat conversion element 3*b* (depicted in FIG. 8), a wiring pattern 4*b* (depicted in FIG. 8), the first protective layer 5, and the second protective layer 6 (depicted in FIG. 9). The electricity-heat conversion element 3*b* includes a plurality of divided heat-generating resistance body films 3*ba* (depicted in FIGS. 8 and 9). The wiring pattern 4*b* includes a plurality of divided wiring patterns 4*ba* (depicted in FIGS. 8 and 9) and slits S2 (depicted in FIG. 8).

The board substrate 1 includes silicon. The oxide film 2 is formed on the board substrate 1. The electricity-heat conversion element 3*b*, serving as a discharging energy generating element, includes a heat-generating resistance body film formed at a predetermined position on the oxide film 2 and having a predetermined size. The electricity-heat conversion element 3*b* bridges both end portions of the wiring pattern 4*b* formed on the oxide film 2. The wiring pattern 4*b* is formed on the oxide film 2 and has a predetermined pattern. The wiring pattern 4*b* electrically connects the electricity-heat conversion element 3*b* to a power source (not shown) to supply power to the electricity-heat conversion element 3*b*. The first protective layer 5 is formed on the electricity-heat conversion element 3*b* and the wiring pattern 4*b*. The second protective layer 6 is formed on the first protective layer 5.

The heat-generating resistance body film of the electricity-heat conversion element 3*b* is divided in a width direction of the electricity-heat conversion element 3*b* into the plurality of divided heat-generating resistance body films 3*ba* serving as divided discharging energy generating elements. The slit S2 is formed between the adjacent divided heat-generating resistance body films 3*ba*. Corresponding to the divided heat-generating resistance body films 3*ba*, the wiring pattern 4*b* is also divided into the plurality of divided wiring patterns 4*ba*. Each of the divided heat-generating resistance body films 3*ba* bridges both end portions of the at least one divided wiring pattern 4*ba*.

The divided wiring pattern 4*ba* may have a band shape like the divided wiring pattern 4*a* illustrated in FIG. 6. According to this non-limiting exemplary embodiment, the divided wiring pattern 4*ba* has a line shape and has a width W3 (depicted in FIGS. 8 and 9) smaller than the width W2 of the divided wiring pattern 4*a* illustrated in FIG. 6. The width W3 corresponds to a width of an area in which an allowable electric current per unit wiring width increases.

The wiring pattern 4*b* has a width not smaller than about 10 μm, for example. At least a part of the wiring pattern 4*b* is divided in a width direction of the wiring pattern 4*b* into the plurality of divided wiring patterns 4*ba*. The divided wiring pattern 4*ba* has a narrow width (i.e., the width W3). Namely, the wiring pattern 4R illustrated in FIG. 1 formed of a single conductive film can be divided into the plurality of divided wiring patterns 4*ba*. Corresponding to the divided wiring patterns 4*ba*, the electricity-heat conversion element 3*b* is also divided into the plurality of divided heat-generating resistance body films 3*ba* having a narrow width. Thus, in a photolithographic process, that is, one of manufacturing processes determining the acceptable quality level of shape and dimensions of the liquid droplet discharging head circuit board 100*b*, a heat-shrunk registration film may not partially narrow the electricity-heat conversion element 3*b* or the wiring pattern 4*b*, resulting in an improved dimension control.

The wiring pattern 4 (depicted in FIG. 6) including the plurality of divided wiring patterns 4*a*, each of which has the width W2 narrower than the width W1, and the wiring pattern 4*b* (depicted in FIG. 8) including the plurality of divided wiring patterns 4*ba*, each of which has the width W3 narrower than the width W1 (depicted in FIG. 1), can reduce product failures caused by a broken wire and can increase yields compared to the single, broad wiring pattern 4R (depicted in FIG. 1).

When the width W2 of the divided wiring pattern 4*a* and the width W3 of the divided wiring pattern 4*ba* are regulated to have a predetermined width or greater, an allowable electric current per unit wiring width can be increased even when the divided wiring patterns 4*a* and 4*ba* occupy an area common to the divided wiring pattern 4R. Thus, when the liquid droplet discharging head circuit board 100 (depicted in FIG. 6) or 100*b* (depicted in FIG. 8) is installed in the image forming apparatus 17 (depicted in FIG. 3), the image forming apparatus 17 can provide an increased reliability.

As illustrated in FIGS. 6 and 8, when the slits S1 and S2 are regulated to have a predetermined width or greater and the first protective layer 5 and the second protective layer 6 (depicted in FIGS. 7 and 9) provide a proper coverage, the liquid droplet discharging head circuit boards 100 and 100*b* can provide an improved ink-proof level, resulting in an increased reliability of the image forming apparatus 17. Modifying only the wiring patterns 4 and 4*b* or the electricity-heat conversion elements 3 and 3*b* can provide the above-described effects.

As described above, when the electricity-heat conversion element 3R or the wiring pattern 4R (depicted in FIG. 1) formed of a conductive film being consecutive in the width direction of the electricity-heat conversion element 3R or the wiring pattern 4R is divided in the width direction into the plurality of narrow divided heat-generating resistance body films 3*ba* (depicted in FIG. 8) or the narrow divided wiring patterns 4*a* (depicted in FIG. 6) or 4*ba* (depicted in FIG. 8), respectively, the liquid droplet discharging head circuit board 100 (depicted in FIG. 6) or 100*b* (depicted in FIG. 8) can provide increased manufacturing yields, an increased allowable electric current per unit wiring width, and an maintained or improved ink-proof level without increasing the number of manufacturing processes.

Figure 10:
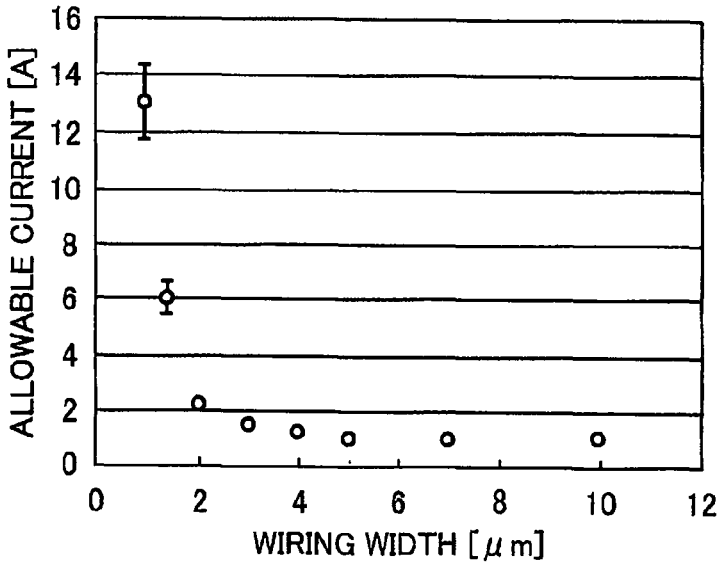
FIG. 10 is a graph illustrating a relationship between an allowable electric current per unit wiring width and a wiring width of the liquid droplet discharging head circuit board shown in FIG. 8.

FIG. 10 is a graph illustrating a relationship between an allowable electric current per unit wiring width and a width of a wiring pattern (i.e., a wiring width). The allowable electric current per unit wiring width corresponds to a maximum current satisfying a predetermined wiring life.

As illustrated in FIG. 10, when the wiring width is greater than about 5 μm the allowable electric current per unit wiring width does not vary. However, when the wiring width of the wiring pattern (i.e., the divided wiring pattern) is not greater than about 4 μm, especially about 2 μm, the allowable electric current per unit wiring width increases. For example, the allowable electric current of a broad wiring width of about 9 μm (for example, the width W1 of the wiring pattern 4R depicted in FIG. 1) is about 1 A. The allowable electric current of a narrow wiring width of about 1 μm is about 13 A. Therefore, when five divided wiring patterns, each of which has the width of about 1 μm, are arranged with a space of about 1 μm (for example, the width of the slit S1 depicted in FIG. 6) provided between two adjacent divided wiring patterns, the five divided wiring patterns provide the allowable electric current of about 65 A. Namely, both one broad wiring pattern having the width of about 9 μm and five divided wiring patterns each having the width of about 1 μm occupy the width of about 9 μm and thereby occupy a common area. However, the five divided wiring patterns provide a greater allowable electric current than the one broad wiring pattern. Thus, when the wiring width is not greater than about 4 μm and a space of at least about 1 μm is provided between two adjacent divided wiring patterns, each of the divided wiring patterns provides an increased allowable electric current per unit wiring width.

As illustrated in FIGS. 6 and 8, according to this non-limiting exemplary embodiment, the wiring patterns 4 and 4*b* include the narrow divided wiring patterns 4*a* and 4*ba*, respectively. Thus, each of the wiring patterns 4 and 4*b* can provide an increased allowable electric current per unit wiring width. Namely, when a single, broad wiring pattern (for example, the wiring pattern 4R depicted in FIG. 1) is divided to include a plurality of narrow, divided wiring patterns (for example, the divided wiring patterns 4*a* or 4*ba*), a user or a service engineer of the image forming apparatus 17 (depicted in FIG. 3) can easily cope with wear of the wiring patterns and a partially broken wire.

When the image forming apparatus 17 includes a thermal type recording head, a protective layer may be formed on a surface of the electricity-heat conversion element 3 or 3*b*. The protective layer can prevent erosion by ink, sticking of an ink component, and cavitation (i.e., an impact caused by a shrunk bubble) from directly affecting and damaging the electricity-heat conversion element 3 or 3*b*, resulting in a longer life of the electricity-heat conversion element 3 or 3*b*.

Figure 11:
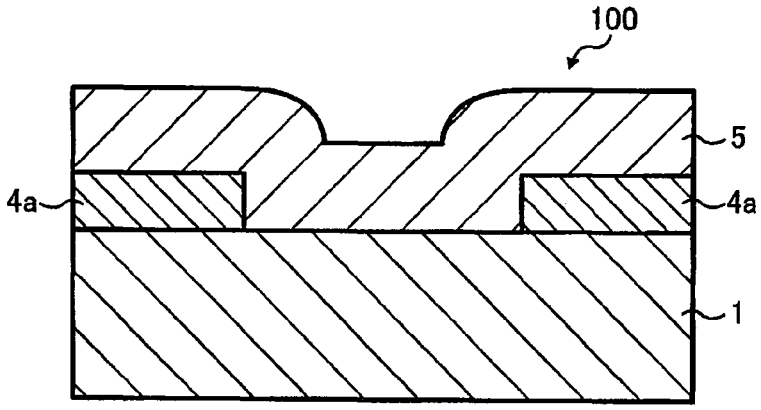
FIG. 11 is an enlarged view of the liquid droplet discharging head circuit board shown in FIG. 7.
Figure 12:
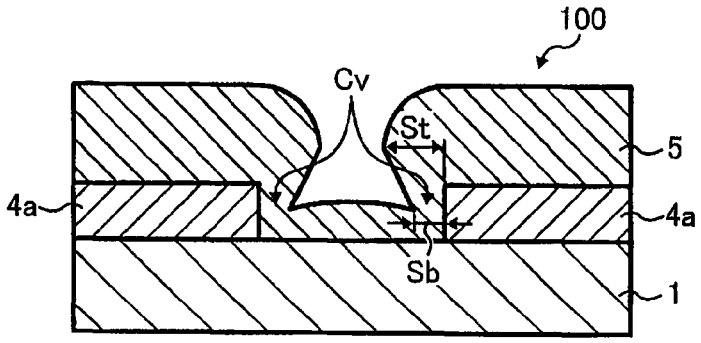
FIG. 12 is another enlarged view of the liquid droplet discharging head circuit board shown in FIG. 7.

FIGS. 11 and 12 illustrate an enlarged view of the liquid droplet discharging head circuit board 100 shown in FIG. 7. The liquid droplet discharging head circuit board 100*b* (depicted in FIG. 9) may have a structure common to the liquid droplet discharging head circuit board 100 shown in FIGS. 11 and 12.

As illustrated in FIG. 11, when the adjacent divided wiring patterns 4*a* are spaced with a substantial distance provided between the divided wiring patterns 4*a*, the first protective layer 5 is formed between the divided wiring patterns 4*a* and has a substantial thickness. However, when the distance between the adjacent divided wiring patterns 4*a* is small as illustrated in FIG. 12, the first protective layer 5 formed between the divided wiring patterns 4*a* has a small thickness. In FIG. 12, an upper thickness St represents a thickness of the first protective layer 5 provided between the adjacent divided wiring patterns 4*a* at a level higher than the top surface of the divided wiring pattern 4*a*. A lower thickness Sb represents a thickness of the first protective layer 5 provided between the adjacent divided wiring patterns 4*a* at a level lower than the top surface of the divided wiring pattern 4*a*. A position Cv represents a position at which the slit S1 (depicted in FIG. 6) is formed.

Figure 13:
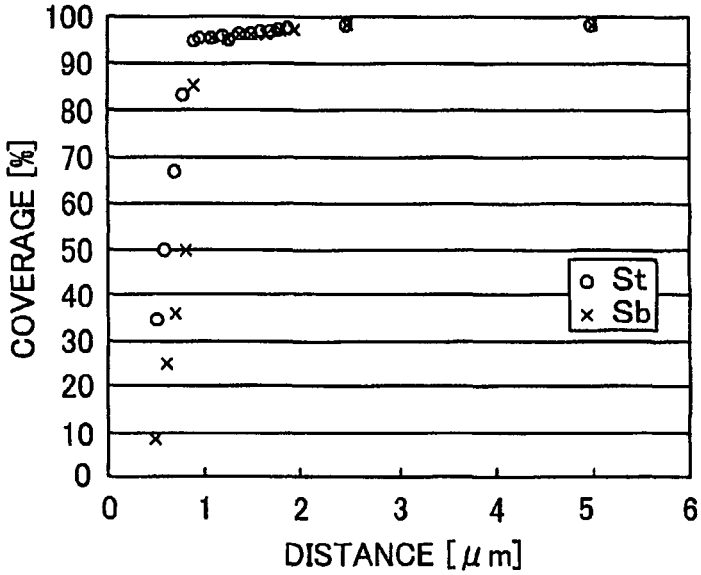
FIG. 13 is a graph illustrating a relationship between a distance between divided wiring patterns and a thickness of a first protective layer between divided wiring patterns of the liquid droplet discharging head circuit board shown in FIG. 12.

FIG. 13 is a graph illustrating a relationship between a coverage and the distance between the adjacent divided wiring patterns 4*a*. The coverage corresponds to a ratio of the distance between the adjacent divided wiring patterns 4*a* to the thickness of the first protective layer 5 between the adjacent divided wiring patterns 4*a*. When the distance between the adjacent divided wiring patterns 4*a* is not smaller than about 1 μm, the coverage is nearly 100 percent and the liquid droplet discharging head circuit board 100 has the shape in cross section as illustrated in FIG. 11.

When the distance between the adjacent divided wiring patterns 4*a* is smaller than about 1 μm, the liquid droplet discharging head circuit board 100 has the shape in cross section as illustrated in FIG. 12. When the distance between the adjacent divided wiring patterns 4*a* is smaller than about 0.7 μm, the slit S1 (depicted in FIG. 6) is formed at the position Cv illustrated in FIG. 12. When an ink erosion occurs, ink erodes the position Cv when the distance between the adjacent divided wiring patterns 4*a* is smaller than about 0.8 μm. To maintain a proper ink-proof level, the distance between the adjacent divided wiring patterns 4*a* is preferably set to be not smaller than about 1 μm.

As described above, when the distance between the adjacent divided wiring patterns 4*a* is not smaller than about 1 μm, the first protective layer 5 having a uniform thickness can be formed in the whole liquid droplet discharging head circuit board 100, including the space provided between the adjacent divided wiring patterns 4*a*. As a result, the liquid droplet discharging head circuit board 100 can provide an improved ink-proof level.

When the image forming apparatus 17 includes a thermal type recording head, a protective layer may be formed on a surface of the electricity-heat conversion element 3 (depicted in FIG. 6) or 3*b* (depicted in FIG. 8). The protective layer can prevent erosion by ink, sticking of an ink component, and cavitation (i.e., an impact caused by a shrunk bubble) from directly affecting and damaging the electricity-heat conversion element 3 or 3*b*, resulting in a longer life of the electricity-heat conversion element 3 or 3*b*.

As described above, the liquid droplet discharging head circuit board 100 (depicted in FIG. 6) or 100*b* (depicted in FIG. 8) can be any type of circuit board used for a liquid droplet discharging head, as long as the circuit board includes a plurality of electricity-heat conversion elements including a heat-generating resistance body. However, the liquid droplet discharging head circuit board 100 or 100*b* is preferably used as a circuit board for a liquid droplet discharging head of an inkjet recording apparatus.

Figure 14:
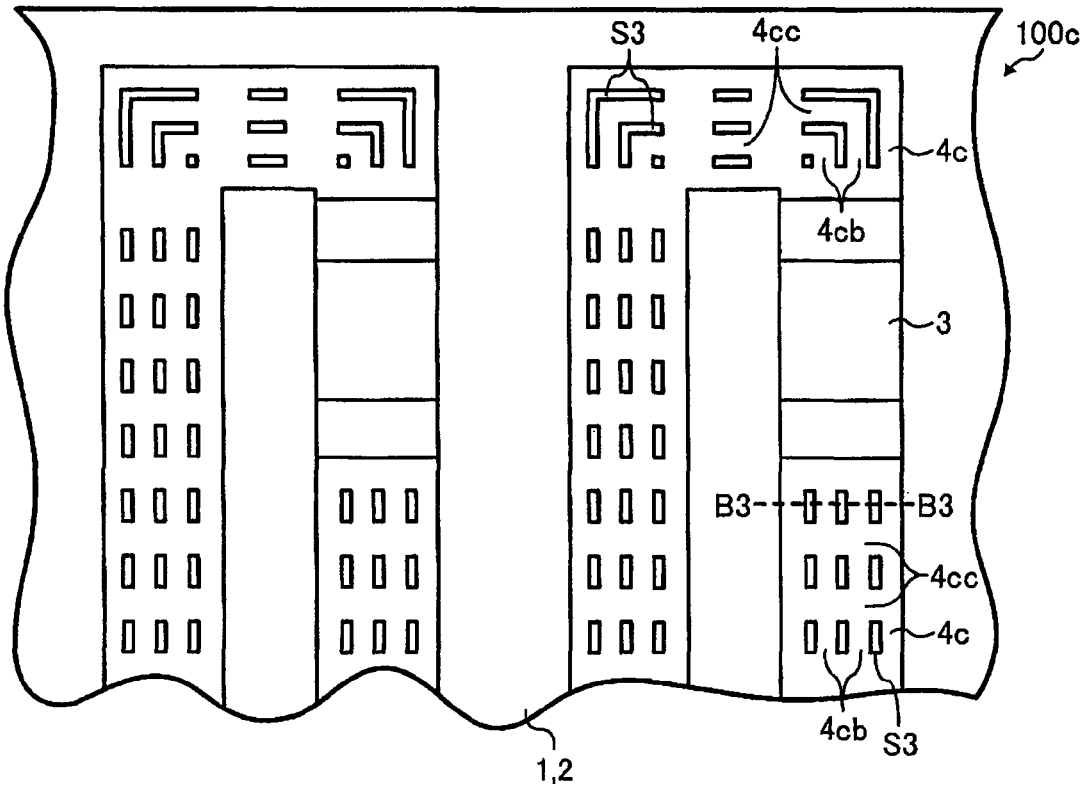
FIG. 14 is a plane view of a liquid droplet discharging head circuit board of the liquid cartridge shown in FIG. 5, according to yet another exemplary embodiment.
Figure 15:
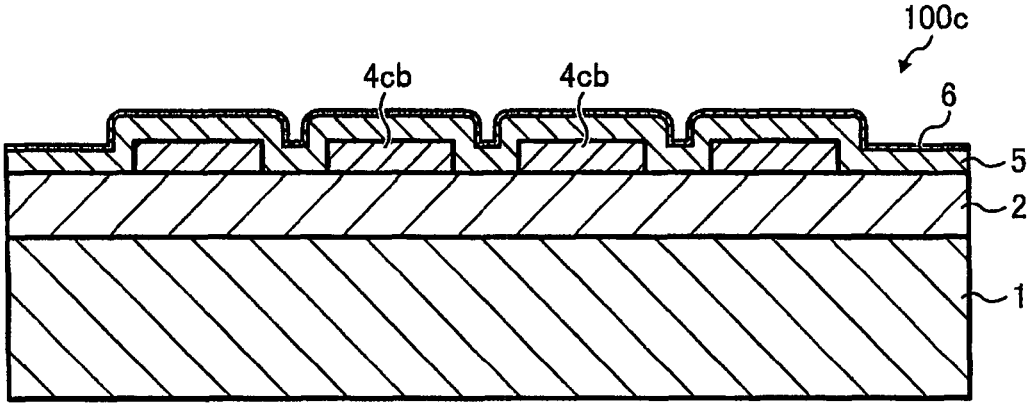
FIG. 15 is a sectional view of the liquid droplet discharging head circuit board shown in FIG. 14 taken on line B3-B3 of FIG. 14.

FIGS. 14 and 15 illustrate a liquid droplet discharging head circuit board 100*c* according to yet another exemplary embodiment. FIG. 14 is a plane view of the liquid droplet discharging head circuit board 100*c*. FIG. 15 is a sectional view of the liquid droplet discharging head circuit board 100*c* taken along line B3-B3 of FIG. 14. As illustrated in FIGS. 14 and 15, the liquid droplet discharging head circuit board 100*c* includes the board substrate 1 (depicted in FIGS. 14 and 15), the oxide film 2 (depicted in FIGS. 14 and 15), the electricity-heat conversion element 3 (depicted in FIG. 14), a wiring pattern 4*c* (depicted in FIG. 14), the first protective layer 5, and the second protective layer 6 (depicted in FIG. 15). The wiring pattern 4*c* includes a plurality of narrow wiring patterns 4*cb* (depicted in FIGS. 14 and 15) and 4*cc* (depicted in FIG. 14) and slits S3 (depicted in FIG. 14).

The oxide film 2 is formed on the board substrate 1. The electricity-heat conversion element 3 is formed on the oxide film 2 and generates heat to discharge an ink droplet. The wiring pattern 4*c* electrically connects the electricity-heat conversion element 3 to a power source (not shown) to supply power to the electricity-heat conversion element 3. At least a part of the wiring pattern 4*c* connected to one electricity-heat conversion element 3 or at least one divided heat-generating resistance body film 3*ba* (depicted in FIG. 8) includes a mesh wiring pattern formed by the narrow wiring patterns 4*cb* and 4*cc* crossed each other. Specifically, the narrow wiring patterns 4*cb* have a narrow width and extend in a longitudinal direction of the wiring pattern 4*c*. The narrow wiring patterns 4*cc* have a narrow width and extend in a width direction of the wiring pattern 4*c*. The plurality of narrow wiring patterns 4*cb* and 4*cc* are crossed each other to form the slits S3 through which the oxide film 2 is exposed. The slit S3 is formed near an intersection point of the narrow wiring patterns 4*bc* and 4*cc* and has a narrow, rectangular shape. The width of each of the narrow wiring patterns 4*cb* and 4*cc* is set in a range in which an allowable electric current per unit wiring width increases (for example, about 4 μm or smaller), as described above in the description for FIG. 10.

When the narrow wiring patterns 4*cb* and 4*cc* are crossed each other to form a mesh, the wiring pattern 4*c* partially has a narrow width. Thus, the wiring pattern 4*c* can provide effects similar to the effects provided by the wiring patterns 4 (depicted in FIG. 6) and 4*b* (depicted in FIG. 8). The widths of the wiring patterns 4 and 4*b* are formed by the plurality of divided wiring patterns 4*a* (depicted in FIG. 6) and 4*ba* (depicted in FIG. 8), respectively. The width of each of the divided wiring patterns 4*a* and 4*ba* is set to a width (for example, about 4 μm or smaller) in which an allowable electric current per unit wiring width increases. Namely, the electric current per unit wiring width flown in a conductive film forming the wiring pattern 4*c* can be increased so that a user or a service engineer of the image forming apparatus 17 (depicted in FIG. 3) can easily cope with wear of the wiring pattern 4*c* and a partially broken wire.

When the distance between the narrow wiring patterns 4*cb* or 4*cc* (i.e., the width of the slit S3) is not smaller than about 1 μm, the first protective layer 5 having a uniform thickness can be formed in the whole liquid droplet discharging head circuit board 100*c*, including the space provided between the narrow wiring patterns 4*cb* or 4*cc*. As a result, the liquid droplet discharging head circuit board 100*c* can provide an improved ink-proof level.

Figure 16:
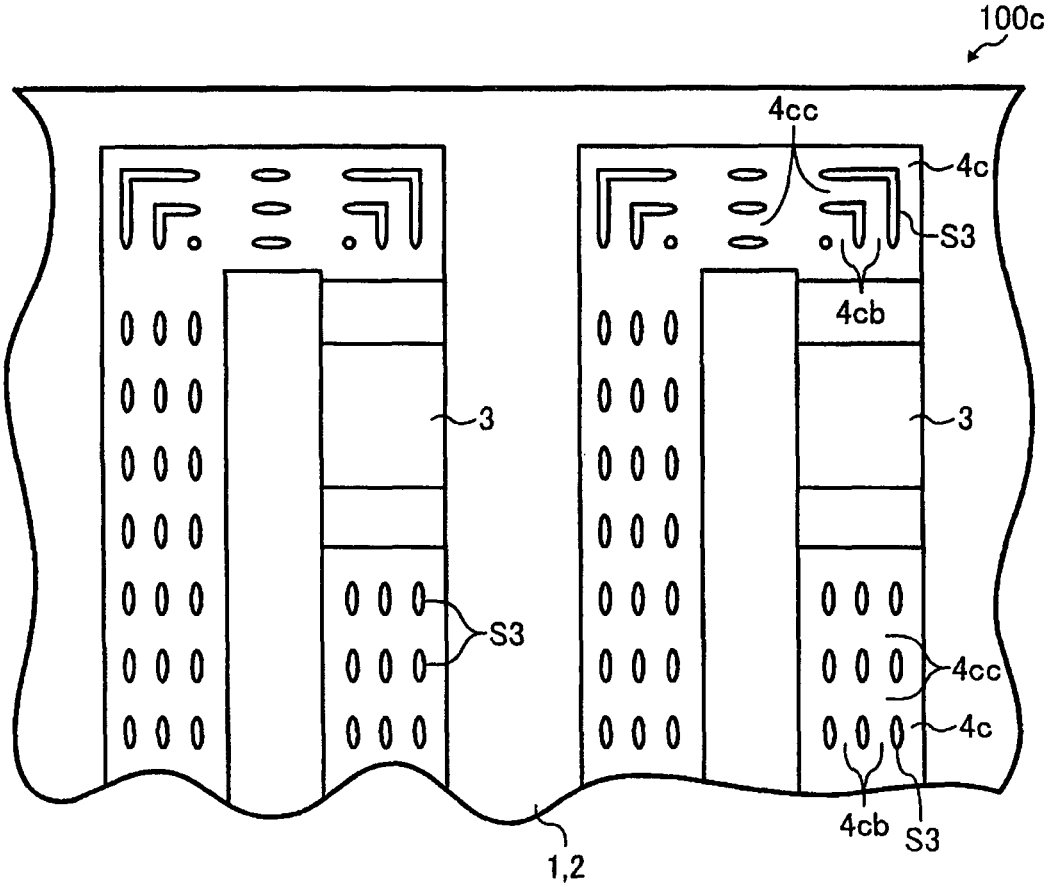
FIG. 16 is a plane view of an example of the liquid droplet discharging head circuit board shown in FIG. 14.

FIG. 16 illustrates another example of the slit S3. The slit S3 illustrated in FIG. 16 has an oval or ellipse shape. However, the slit S3 may have other shapes. In FIG. 16, the slits S3 are aligned in a longitudinal direction of the wiring pattern 4*c*. However, the slits S3 may be provided in a zigzag condition.

Figure 17:
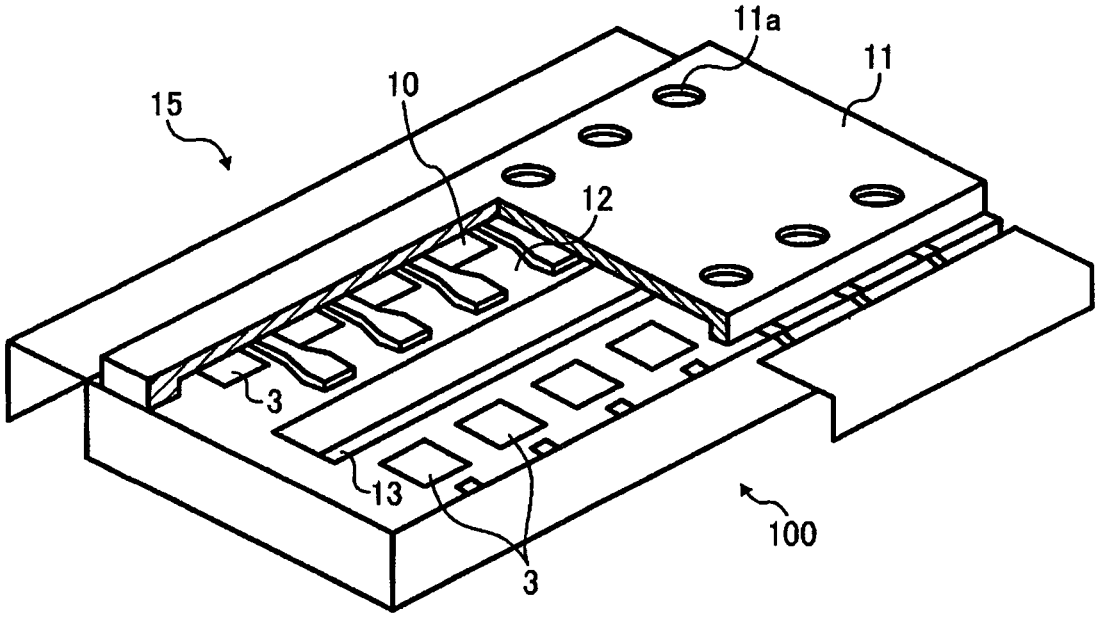
FIG. 17 is a perspective view of a liquid droplet discharging head of the liquid cartridge shown in FIG. 5.
Figure 18:
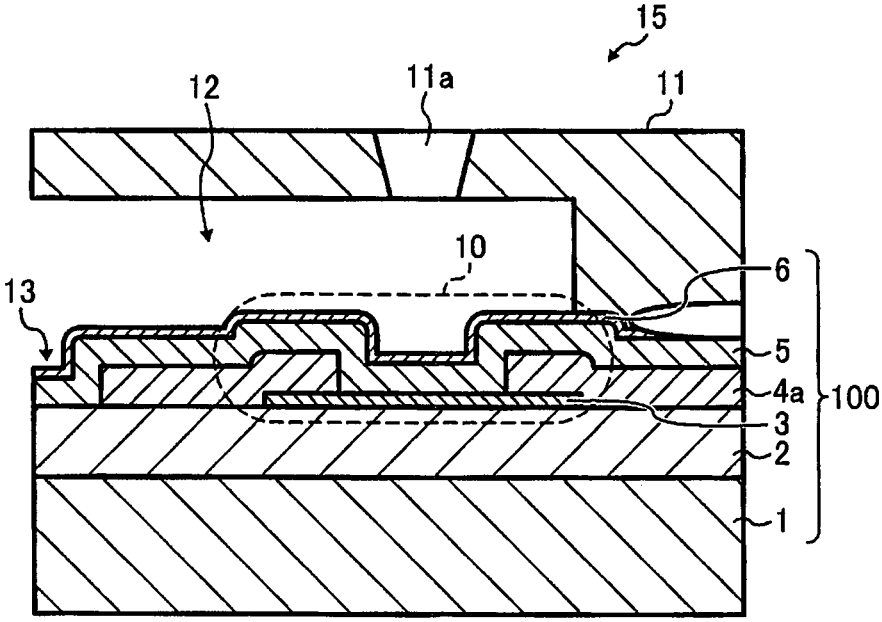
FIG. 18 is a sectional view of the liquid droplet discharging head shown in FIG. 17.

FIGS. 17 and 18 illustrate the recording head 15 including the liquid droplet discharging head circuit board 100. FIG. 17 is a perspective view of the recording head 15. FIG. 18 is a sectional view of the recording head 15. The following describes a circuit board installed in the recording head 15 as an example of the liquid droplet discharging head circuit board 100. The following description is also applicable to the liquid droplet discharging head circuit boards 100*b* and 100*c*. As illustrated in FIGS. 17 and 18, the recording head 15 includes the liquid droplet discharging head circuit board 100, a wall 11, an ink room 12, and an ink inlet 13. As illustrated in FIG. 18, the liquid droplet discharging head circuit board 100 includes the board substrate 1, the oxide film 2, and a heat generator 10. The heat generator 10 includes the electricity-heat conversion element 3, the divided wiring pattern 4*a*, the first protective layer 5, and the second protective layer 6. As illustrated in FIGS. 17 and 18, the wall 11 includes the ink outlet 11*a*.

The board substrate 1 includes silicon. The oxide film 2 is formed on the board substrate 1. The electricity-heat conversion element 3 and the divided wiring pattern 4*a* are provided on the oxide film 2. The first protective layer 5 is formed on the electricity-heat conversion element 3 and the divided wiring pattern 4*a*. The second protective layer 6 is formed on the first protective layer 5.

The heat generators 10 are disposed with a predetermined pitch provided between the adjacent heat generators 10. The electricity-heat conversion element 3 includes a heat-generating resistance body film bridging both end portions of the divided wiring pattern 4*a*.

The wall 11 is disposed above the heat generator 10 and includes a photosensitive resin. The ink outlet 11*a*, through which an ink droplet is discharged, is formed in the wall 11. The ink room 12, from which an ink droplet is supplied to the ink outlet 11*a*, is formed between the wall 11 and the liquid droplet discharging head circuit board 100. The ink inlet 13, through which an ink droplet is supplied to the ink room 12, is formed on the liquid droplet discharging head circuit board 100.

The following describes how to manufacture the recording head 15. A heat-generating resistance body film forming the electricity-heat conversion element 3 and a conductive film forming the wiring pattern 4 or the divided wiring pattern 4*a* are patterned on a large silicone wafer by using a photolithographic technology. The wall 11 is formed in an area corresponding to the board substrate 1 to form the ink room 12. The ink outlet 11*a* is formed in the wall 11. The ink outlet 13 is formed on the liquid droplet discharging head circuit board 100 by anisotropic etching, for example. Then, the silicone wafer is cut into a predetermined size.

The following describes how to manufacture the liquid droplet discharging head circuit board 100. The following description is also applicable to the liquid droplet discharging head circuit boards 100*b* (depicted in FIG. 9) and 100*c* (depicted in FIG. 14). A silicone board is prepared as the board substrate 1. The silicone board is thermally oxidized to form an oxide silicone film having a thickness of about several micrometers as the oxide film 2.

A heat-generating resistance body film having a thickness of about 50 nm as the electricity-heat conversion element 3 is formed on a predetermined position on the oxide film 2 by spattering. According to this non-limiting exemplary embodiment, the heat-generating resistance body film forming the electricity-heat conversion element 3 includes tantalum nitride (TaN). However, the heat-generating resistance body film may include hafnium diboride ($HfB_2$) and/or tantalum silicon nitride (TaSiN). Etching is performed on the heat-generating resistance body film to form the electricity-heat conversion element 3 having a predetermined pattern by the photolithographic technology, for example.

A conductive film including aluminum and having a thickness of about 200 nm as the wiring pattern 4 or the divided wiring pattern 4*a* is formed by spattering. According to this non-limiting exemplary embodiment, the wiring pattern 4 or the divided wiring pattern 4*a* includes aluminum. However, the wiring pattern 4 or the divided wiring pattern 4*a* may include an alloy, for example, aluminum-silicone (Al—Si), aluminum-cupper (Al—Cu), and/or aluminum-silicone-copper (Al—Si—Cu).

The aluminum film is processed into the wiring pattern 4 or the divided wiring pattern 4*a* having a predetermined pattern by using the photolithographic technology. Specifically, etching (for example, dry etching) is performed on a conductive film. Thus, a portion not eroded by etching forms the wiring pattern 4 or the divided wiring pattern 4*a*.

The first protective layer 5 including plasma nitride silicon (P—SiN) is formed by a CVD (chemical vapor deposition) method to have a thickness of about 300 nm. The first protective layer 5 may include oxide silicone. The second protective layer 6 including tantalum (Ta) is formed by spattering to have a thickness of about 230 nm. The second protective layer 6 may include tantalum nitride (TaN) and/or tantalum silicon nitride (TaSiN) instead of tantalum (Ta). The second protective layer 6 is patterned again by a photolithographic method, and is etched by dry etching to remove an unnecessary tantalum portion.

Electric wiring used for sending and receiving an electric signal to drive the electricity-heat conversion element 3 is connected to the liquid droplet discharging head circuit board 100 by a mounting technology. Namely, a power transistor and a CMOS (complementary metal oxide semiconductor) logic circuit are formed on the liquid droplet discharging head circuit board 100 by using a semiconductor technology. The power transistor switches an electric current flow to the electricity-heat conversion element 3. The CMOS logic circuit controls the power transistor. The power transistor and the CMOS logic circuit are connected to the electricity-heat conversion element 3 via the wiring pattern 4 or the divided wiring pattern 4*a*.

According to this non-limiting exemplary embodiment, the ink outlets 11*a* disposed in parallel to each other and opposing each other via the ink inlet 13 are shifted or staggered each other by a half pitch. The ink room 12 corresponding to the ink outlet 11*a* is spaced from the adjacent ink room 12 by a pitch of about 600 dpi in each row of the ink outlets 11*a*. The heat generator 10 is spaced from the adjacent heat generator 10 by a predetermined pitch on an inner bottom of the ink room 12. Thus, the ink outlet 11*a* discharges an ink droplet in a predetermined amount.

As illustrated in FIG. 4, the printing mechanism 19 includes the recording head 15. The recording head 15 can reduce ink droplet discharging errors caused by heat, resulting in a stable ink droplet discharging operation and an increased quality of an image formed with ink droplets discharged by the recording head 15. The recording head 15 can discharge a pigment, a dye, or a mixture of the pigment and the dye as a colorant.

As illustrated in FIG. 3, the image forming apparatus 17 including the recording head 15 can reduce variations in ink droplet discharging property, providing an improved reliability. Therefore, the recoding head 15 can also be used as a line type recording head which does not move in the main scanning direction to discharge an ink droplet and can provide an improved reliability.

The liquid droplet discharging head circuit boards 100 (depicted in FIG. 6), 100*b* (depicted in FIG. 8), and 100*c* (depicted in FIGS. 14 and 16) are applicable to any circuit board used for discharging an ink droplet, as long as the circuit board includes a plurality of heat-generating resistance bodies. The recording head 15 (depicted in FIG. 5) including the liquid droplet discharging head circuit board 100, 100*b*, or 100*c* is applicable to the image forming apparatus 17 (depicted in FIG. 3), for example, a copying machine, a printer, a facsimile machine, and a multifunction printer having copying, printing, scanning, and facsimile functions.

The liquid droplet discharging head circuit boards 100, 100*b*, and 100*c* are also applicable to a liquid droplet discharging head and a liquid droplet discharging device for discharging a liquid droplet other than ink, for example, a DNA (deoxyribonucleic acid) sample and a material for registration and patterning.

According to the above-described non-limiting exemplary embodiments, at least a part of a broad wiring pattern (i.e., the wiring pattern 4 depicted in FIG. 6, the wiring pattern 4*b* depicted in FIG. 8, or the wiring pattern 4*c* depicted in FIG. 14 or 16) includes a plurality of narrow, divided wiring patterns (i.e., the divided wiring patterns 4*a* depicted in FIG. 6, the divided wiring patterns 4*ba* depicted in FIG. 8, or the narrow wiring patterns 4*cb* and 4*cc* depicted in FIG. 14 or 16). The widths of the divided wiring patterns are in a predetermined range, resulting in an increased migration resistance, reduced variations in finished dimension, and an increased allowable electric current per unit wiring width. The distance between the divided wiring patterns is regulated, resulting in formation of an insulating film with an increased coverage, an increased ink resistance, and an increased reliability.

When the broad wiring pattern is divided into the plurality of divided wiring patterns having a narrow width, an allowable electric current per unit wiring width increases substantially, preventing the wiring pattern from being damaged or partially broken.

According to the above-described non-limiting exemplary embodiments, the wiring pattern includes a conductive film connected to a discharging energy generating element (i.e., the electricity-heat conversion element 3 depicted in FIG. 6 or the electricity-heat conversion element 3*b* depicted in FIG. 8) as one example. However, the structure of the wiring pattern can be applied to general wiring patterns formed on a board (i.e., the board substrate 1 depicted in FIGS. 7, 9, and 15).

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese patent application No. 2006-026413 and Japanese application No. 2006-280752 filed on Feb. 2, 2006 and Oct. 13, 2006, respectively, in the Japan Patent Office, the entire contents of which are hereby incorporated herein by reference.

What is claimed is:

1. A recording apparatus, comprising:

a liquid droplet discharging head configured to discharge a liquid droplet and including a liquid droplet discharging head circuit board configured to cause said liquid droplet discharging head to discharge said liquid droplet, the liquid droplet discharging head circuit hoard including a hoard substrate, an electricity-heat conversion element configured to generate heat, thereby causing the liquid droplet discharging head to discharge said liquid droplet, a wall provided with a liquid outlet corresponding to the electricity-heat conversion element, through which a liquid droplet is discharged, and a wiring pattern located on the board substrate to supply power and connected to the electricity-heat conversion element, the wiring pattern including a plurality of divided wiring patterns connected directly to the same single electricity-heat conversion element in a state in which the plurality of divided wiring patterns are mounted on the same single electricity-heat conversion element, each divided wiring pattern amongst the plurality of divided wiring patterns electrically connecting the same single electricity-heat conversion element to a same power source, the plurality of divided wiring patterns having been formed by dividing least a part of the wiring pattern in a width direction of the wiring pattern, and the plurality of divided wiring patterns being connected to the same one electricity-heat conversion element corresponding to the liquid outlet, in a state in which the plurality of divided wiring patterns are not simultaneously connected to any other electricity-heat conversion element; and a tank configured to supply a liquid to the liquid droplet discharging head, wherein each of the plurality of divided wiring patterns has a width that provides an allowable electric current per unit wiring width greater than an allowable electric current per unit wiring width of a single wiring pattern having a width equivalent to a combined width of the plurality of divided wiring patterns obtained by adding all of the widths of the plurality of divided wiring patterns to a space provided between two adjacent divided wiring patterns.

2. The recording apparatus according to claim 1, further comprising:

a liquid cartridge including the liquid droplet discharging head and the tank, wherein the liquid droplet discharging head is integrated with the tank in said liquid cartridge.

3. The recording apparatus according to claim 2, wherein the liquid droplet discharging head discharges said liquid droplet without moving in a main scanning direction.

4. The recording apparatus according to claim 1, wherein the wiring pattern is connected to the electricity-heat conversion element to supply said power to the electricity-heat conversion element.

5. The recording apparatus according to claim 1, wherein at least a part of the wiring pattern connected to the electricity-heat conversion element includes a mesh wiring pattern in which a plurality of narrow wiring patterns are crossed each other.

6. The recording apparatus according to claim 5, wherein each of the plurality of narrow wiring patterns has a width that provides an allowable electric current per unit wiring width greater than an allowable electric current per unit wiring width of a single wiring pattern having a width equivalent to a combined width of the plurality of narrow wiring patterns obtained by adding all of the widths of the plurality of narrow wiring patterns to a space provided between two adjacent narrow wiring patterns.

7. The recording apparatus according to claim 6, wherein the width of each of the plurality of narrow wiring patterns is in a range of 1 μm to 4 μm.

8. The recording apparatus according to claim 1, wherein the width of said each of the plurality of divided wiring patterns is in a range of 1 μm to 4 μm.

9. A liquid droplet discharging head for discharging a liquid droplet, comprising:

a liquid droplet discharging head circuit board configured to cause said liquid droplet discharging head to discharge said liquid droplet, including a board substrate, a electricity-heat conversion element configured to generate heat, thereby causing the liquid droplet discharging head to discharge said liquid droplet, a wall provided with a liquid outlet corresponding to the electricity-heat conversion element, through which a liquid droplet is discharged, and a wiring pattern located on the board substrate to supply power and connected to the electricity-heat conversion element, wherein the wiring pattern includes a plurality of divided wiring patterns connected directly to the same single electricity-heat conversion element in a state in which the plurality of divided wiring patterns are mounted on the same single electricity-heat conversion element, each divided wiring pattern amongst the plurality of divided wiring patterns electrically connecting the same single electricity-heat conversion element to a same power source, the plurality of divided wiring patterns having been formed by dividing at least a part of the wiring pattern in a width direction of the wiring pattern, and the plurality of divided wiring patterns are connected to the same one electricity-heat conversion element corresponding to the liquid outlet, in a state in which the plurality of divided wiring patterns are not simultaneously connected to any other electricity-heat conversion element, wherein each of the plurality of divided wiring patterns has a width that provides an allowable electric current per unit wiring width greater than an allowable electric current per unit wiring width of a single wiring pattern having a width equivalent to a combined width of the plurality of divided wiring patterns obtained by adding all of the widths of the plurality of divided wiring patterns to a space provided between two adjacent divided wiring patterns.

10. A liquid droplet discharging head circuit board configured to cause a liquid droplet discharging head to discharge a liquid droplet, comprising:

a board substrate;

an electricity-heat conversion element configured to generate heat, thereby causing the liquid droplet discharging head to discharge said liquid droplet;

a wall provided with a liquid outlet corresponding to the electricity-heat conversion element, through which a liquid droplet is discharged; and a wiring pattern located on the board substrate to supply power and connected to the electricity-heat conversion element, wherein the wiring pattern includes a plurality of divided wiring patterns connected directly to the same single electricity-heat conversion element in a state in which the plurality of divided wiring patterns are mounted on the same single electricity-heat conversion element, each divided wiring pattern amongst the plurality of divided wiring patterns electrically connecting the same single electricity-heat conversion element to a same power source, the plurality of divided wiring patterns having been formed by dividing at least a part of the wiring pattern in a width direction of the wiring pattern, and the plurality of divided wiring patterns are connected to the same one electricity-heat conversion element corresponding to the liquid outlet, in a state in which the plurality of divided wiring patterns are not simultaneously connected to any other electricity-heat conversion element, wherein each of the plurality of divided wiring patterns has a width that provides an allowable electric current per unit wiring width greater than an allowable electric current per unit wiring width of a single wiring pattern having a width equivalent to a combined width of the plurality of divided wiring patterns obtained by adding all of the widths of the plurality of divided wiring patterns to a space provided between two adjacent divided wiring patterns.

11. The liquid droplet discharging head circuit hoard according to claim 10, wherein the wiring pattern is connected to the electricity-heat conversion element to supply said power to the electricity-heat conversion element.

12. The liquid droplet discharging head circuit board according to claim 11, wherein at least a part of the wiring pattern connected to the electricity-heat conversion element includes a mesh wiring pattern in which a plurality of narrow wiring patterns are crossed each other.

* * * * *